US008517143B2

(12) United States Patent
Schoenfeld

(10) Patent No.: US 8,517,143 B2
(45) Date of Patent: Aug. 27, 2013

(54) ARRANGEMENT OF A SILENCER ON A COMBUSTION MOTOR WITH IMPROVED COUPLING TO THE CYLINDER

(75) Inventor: Michael Schoenfeld, Rohlstorf (DE)

(73) Assignee: Makita Corporation, Anjo-Shi (JP)

( * ) Notice: Subject to any disclaimer, the term of this patent is extended or adjusted under 35 U.S.C. 154(b) by 0 days.

(21) Appl. No.: 13/401,387

(22) Filed: Feb. 21, 2012

(65) Prior Publication Data

US 2012/0228049 A1 Sep. 13, 2012

(30) Foreign Application Priority Data

Mar. 9, 2011 (DE) ..... 20 2011 000 529 U

(51) Int. Cl.
*F01N 13/10* (2010.01)

(52) U.S. Cl.
USPC ..... 181/240; 181/212; 181/228

(58) Field of Classification Search
USPC ..... 181/240, 228, 212
See application file for complete search history.

(56) References Cited

U.S. PATENT DOCUMENTS

| | | | | |
|---|---|---|---|---|
| 4,854,417 | A * | 8/1989 | Uesugi et al. | 181/272 |
| 5,048,290 | A | 9/1991 | Lavenius et al. | |
| 6,955,043 | B2 * | 10/2005 | Schlossarczyk et al. | 60/299 |
| 7,357,221 | B2 * | 4/2008 | Maier | 181/268 |
| 8,251,173 | B2 * | 8/2012 | Drew et al. | 181/240 |
| 2001/0037912 | A1 * | 11/2001 | Menzel | 181/231 |
| 2006/0219203 | A1 * | 10/2006 | Kellermann | 123/184.57 |
| 2007/0251761 | A1 * | 11/2007 | Nishimura et al. | 181/258 |
| 2011/0017336 | A1 | 1/2011 | Drew et al. | |

FOREIGN PATENT DOCUMENTS

| | | | |
|---|---|---|---|
| DE | 24 23 507 | A1 | 11/1975 |
| DE | 195 81 467 | T1 | 6/2000 |
| DE | 10 2007 038 199 | A1 | 3/2008 |
| DE | 20 2008 005 168 | | 8/2009 |
| EP | 0 717 176 | A1 | 6/1996 |
| EP | 0 759 501 | A1 | 2/1997 |
| JP | A-2009-047146 | | 3/2009 |

OTHER PUBLICATIONS

German Search Report issued in Application No. 20 2011 000 529.1; Dated Jul. 27, 2011 (With Translation).
European Search report dated Jun. 28, 2012 issued in European Patent Application No. 12154949.7 (w/translation).

* cited by examiner

*Primary Examiner* — Forrest M Phillips
(74) *Attorney, Agent, or Firm* — Oliff & Berridge, PLC

(57) ABSTRACT

In order to improve an arrangement of a silencer on a combustion motor, whereby the silencer has a connection piece which with an end area adjoins an outlet in the cylinder of the combustion motor forms a flow connection between a combustion chamber of the combustion motor and the silencer in such a way a disturbance-free flow connection between a combustion chamber in the cylinder and the silencer is made possible, and more particularly to simplify the mounting of a silencer on the cylinder of a combustion motor, the internal diameter of the end area is made larger than the internal diameter of the outlet.

10 Claims, 3 Drawing Sheets

ARRANGEMENT OF A SILENCER ON A COMBUSTION MOTOR WITH IMPROVED COUPLING TO THE CYLINDER

The present invention relates to an arrangement of a silencer on a combustion motor in accordance with the introductory section of claim 1, whereby the silencer is designed with a connection piece which with an end section adjoins an outlet in the cylinder of the combustion and forms a flow connection between a combustion chamber of the combustion motor and the silencer.

PRIOR ART

From DE 195 81 467 T1 a silencer for a combustion motor is known and the silencer is designed with a connection piece in the form of a metal sleeve made of steel, and with an end section connection piece adjoining an outlet in the cylinder of the combustion motor in order to form a flow connection between a combustion chamber of the combustion motor and the silencer. The metal sleeve is designed in one piece and adjoins the housing of the silencer in the areas of the inlet to the silencer. Body edges of metal components projecting into the flow connection can disturb the flow of the exhaust gas and result in vortex formation, which with the special design of the silencer can lead to undesirable disruptions.

DE 24 23 507 A1 shows a connection piece between the outlet of a cylinder and an exhaust pipe which forms a flow connection between the combustion chamber of the combustion motor and the exhaust pipe, and the exhaust pipe can open out into a silencer. The form and shape of the connection piece is adapted to the outlet in the cylinder and precise mounting of the exhaust pipe on the cylinder is required to create a flush arrangement of the exhaust pipe on the cylinder with the connection piece. The connection also has an open pipe end facing the direction of the exhaust pipe, on which vortices can also form in the exhaust gas flow, which are be avoided.

FIG. 2 shows a further prior art, and a silencer 100 in indicated through a housing area. The silencer 100 is for arranging on a combustion motor, which shown by the partial depiction of a cylinder 18 and in which a combustion chamber 13 if formed. On the silencer 100 there is a connection piece 25 with an internal diameter $D_{AN}$, which with an end section 27 adjoins an outlet 26 with an internal diameter $D_{AU}$ in the cylinder 18 of the combustion motor in order to form a flow connection between the combustion chamber 13 and the silencer 100.

Such a connection piece 25 is also known by the name "Portliners" and partially projects into the outlet 26, and the outlet 26 widened in the area into which the end area 27 of the connection piece 25 projects. The internal diameter $D_{AN}$ of the connection piece 25 and the internal diameter $D_{AU}$ of the outlet are identical and a continuous flow connection between the combustion chamber 13 and the silencer 100 is formed. However, between the end area 27 of the connection piece 25 and the outlet 26 a transition area i formed which can lead to vortex formation in the exhaust gas flow. More particularly, very precise positioning of the silencer 100 in the outlet 26 of the cylinder 18 is required and only a slightly off-centre arranged or tilting of the silencer 100 on the cylinder 18 can result in larger edges in the flow connection which bring about increased vortex formation. The connection piece 25 is shown with a centring attachment 30, but in the event of tilting of the silencer 100 through the end area 27 of the connection pieces 25, despite the centring attachment 30, edge formation can occur which brings about vortex formation in the exhaust gas flow through the connection piece 25 and the outlet 26.

The combustion motor can be a two-stroke motor and the silencer can allow exhaust gas return flow in the direction of the combustion chamber in order to prevent non-combusted fuel-air mixture reaching the silencer. The silencer can have a specially designed chamber and corresponding flow connection between the silencer inlet and the chamber, so that on opening the outlet of the cylinder the exhaust gas can initially flow out of the combustion chamber via a flow channel into the chamber, and after filling the chamber a large part of the exhaust gas can flow back in the direction of the silencer inlet. The returning exhaust gas thus forms a gas barrier against opening of the combustion chamber, and non-combusted fuel-air mixture which on load alternation has reached the silencer inlet from the combustion chamber, can be forced back into the combustion chamber by the back-flowing exhaust gas. This principle requires a special design of the flow channel between the combustion chamber and the first chamber in the silencer, and the flow of the exhaust gas should if possible be vortex-free, more particularly the exhaust gas flows thorough the connection piece and the outlet from both directions, and the return flow principle of the exhaust gas in the silencer can be utilised particularly effectively.

DISCLOSURE OF THE INVENTION

It is therefore the aim of the present invention to improve the arrangement of a silencer on the outlet of a cylinder of a combustion motor in such a way that a disruption-free flow connection between a combustion chamber in the cylinder and the silencer is made possible. More particularly, the aim of the present invention is to facilitate the mounting of a silencer on the cylinder of a combustion motor.

This is achieved on the basis of an arrangement of a silencer on a combustion motor in accordance with the introductory section of claim 2 in connection with the characterising features. Advantageous further embodiments of the invention are set out in the dependent claims.

The invention includes the technical teaching that the inner diameter of the end area of the connection piece is larger than the inner diameter of the outlet in the cylinder of the combustion motor.

Thus, in accordance with the invention the connection piece forms an end area which has an internal diameter which at least differs from the internal diameter of the connection pieces and the internal diameter of the end section of the connection piece should at least be greater than the internal diameter of the outlet. This results in the advantage that the impact area of the end section of the connection piece is taken out at least a little more radially from the main flow of the exhaust gas at outlet on the cylinder. Through the enlargement of the inner diameter of the end area the impact area of the end area on the outlet is not directly in the flow connection and vortex formation, which can continue as vortex drag in the exhaust gas can largely be avoided. It was found that just by enlarging the inner diameter of the end area of the connection piece vortex formation of the exhaust gas could largely be prevented both coming from the combustion chamber in the direction of the silencer and also in the inverse direction. The advantage is also achieved that slightly off-centre mounting of the connection piece in the outlet on the cylinder of the combustion motor has no negative effect on the flow behaviour of the exhaust gas, as even with misaligned arrangement of the connection piece on the outlet no edges would be formed in a transition area which would project into the flow area.

In accordance with an advantageous form of embodiment the connection piece can have an internal diameter which increases continuously and more particularly without jumps in diameter, up to the internal diameter of the end area. The connection piece and in particular the end area of the connection pieces can be rotation symmetrically arranged around a channel flow direction and the end areas can be formed by a funnel-shaped expansion of the connection piece. For example, the connection piece can be made of a metal sleeve and the end area can be extended by a pin. If the internal diameter of the connection piece increases continuously towards the end area, a soft contour without edges and jumps in diameter is formed and the outer edge of the end area can be brought into contact against the outlet, whereby the end area is widened to a diameter which is larger than the main diameter of the flow connection though which the exhaust gas flows.

In accordance with a further advantageous form of embodiment the internal diameter of the connection piece and the internal diameter of the outlet can be the same. Consequently the diameter of the flow connection only increases in the end area of the connection piece, and the internal diameter of the connection piece, which is not widened, can match the internal diameter of the outlet. Through the constant internal diameter of the outlet in the transition in the connection piece the exhaust gas flows at a constant flow rate without the flow being accelerated through a constriction of the flow.

Alternatively the internal diameter of the connection piece can be smaller than the internal diameter of the outlet. This achieves the advantage that the edge, formed by the end of the outlet in the wall of the cylinder has a lesser influence on the flow behaviour of the exhaust gas in the flow connection. The diameter of the outlet can be between the internal diameter of the connection piece and the internal diameter of the end area of the connection piece. As a result the end area radially projects over the diameter of the outlet and through the smaller diameter of the connection piece is weakened in its influence on the flow behaviour of the exhaust gas.

Preferably the cylinder can have a planar connection surface extending round the outlet and the connection piece be arranged by means of retaining means with the end area on the connection surface. The retaining means can for example be clips which have a certain spring effect and the silencer can be arranged with the connection piece slightly off-centre to the outlet on the cylinder without jamming or tensioning of the connection piece in the outlet of the cylinder. Consequently the channel flow direction in which the connection piece and the outlet in the cylinder extends forms a normal to the connection surface on the outside of the cylinder Advantageously the outer surface can have a transition area which extends from a planar section of the connection surface into the outlet forming a rounded area. By forming a rounded area an edge between the outlet and the connection surface is avoided, which, more particularly could affect the exhaust gas flow when the exhaust gas flows back from the silencer to the combustion chamber of the cylinder. If the transition area is rounded, for example by forming a radius between the connection surface and the inner wall of the outlet, a further edge is avoided which could project into the flow area of the exhaust gas.

With its end area the connection piece of the silencer can form a silencer inlet, which becomes a flow channel, whereby the flow channel extends into the silencer and at the channel end opposite the silencer inlet opens out into a first chamber, whereby the flow channel between the silencer inlet and the first chamber is designed in such a flow-beneficial manner that due to its mass inertia the exhaust gas flowing into the silencer inlet predominantly flows into the first chamber and after filling the chamber flows back again and thereby create a counterpressure in the direction of the combustion chamber. In this way a gas barrier is formed through which the emergence of non-combusted fuel-air mixture from the combustion chamber is prevented, or fuel-gas mixture that has entered silencer inlet can be conveyed back into the combustion chamber by the returning exhaust gas.

In addition, the silencer can have a second chamber into which the exhaust gas flows through a main outlet branched off from the flow channel and from which the exhaust gas flow out through an outlet, whereby, for example the first chamber can be surrounded by the second chamber.

BRIEF DESCRIPTION OF THE DRAWINGS

Further measures improving the invention are set out in more detail below together with the description of preferred samples of embodiment of the invention with the aid of the figures.

PREFERRED EXAMPLES OF EMBODIMENT OF THE INVENTION

Figure 1:
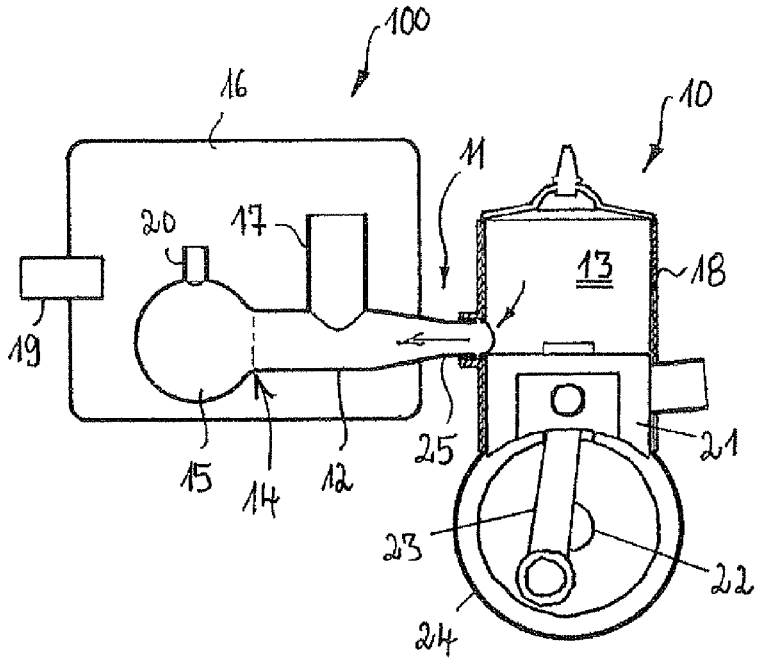
Fig. 1 Prior Art
FIG. 1 shows an example of embodiment of a silencer arranged on a combustion motor with improved coupling to the cylinder of the combustion motor.

FIG. 1 show a silencer 100 arranged on a combustion motor 10, designed as a two-stroke motor. The combustion motor 10 has a cylinder 18 in which there is a combustion chamber 13. The combustion chamber 13 is movably limited by the piston 21, which is stoke-guided in the cylinder 18 and connected via a connecting rod 23 to a crankshaft 22 to form a crank assembly. The cylinder 18 is arranged in a known manner on a crank housing 24 in which the crankshaft 22 is borne.

In the wall of the cylinder 18 is an outlet to which the silencer 100 is attached via a connection piece 25. The outlet and the connection piece 25 thus form a silencer inlet 11 which in the area of the lower dead centre of the piston 21 opens a flow connection between the combustion chamber 13 in the cylinder 18 and the silencer 100, and exhaust gas can flow through the silencer inlet 11 into the silencer 100.

Connected to the silencer inlet 11 is flow channel 12 which with a channel end 14 opposite the silencer inlet 11 opens out into a first chamber 15. The silencer 100 also has a second chamber 16 which is, for example, larger than the first chamber 15 can completely surrounds the first chamber 15 as well as part of the flow channel 12. The exhaust gas flowing into the silencer inlet 11 can initially at least party ender the first chamber 15, whereby a main outlet 17 is arranged on the flow channel 12 and the exhaust gas can flow from the flow channel 12 though the main outlet 17 into the second chamber 16. The first chamber 15 also as a secondary outlet 20, so that exhaust gas can also flow directly from the first chamber 15 into the second chamber 16. Through an outlet 19 in the wall of the second chamber 16 the exhaust gas can leave the silencer 100 and be released into the open.

The flow channel 12 and the connection piece 25 are jointly designed in such a flow-beneficial manner, that due to its mass inertia, exhaust gas flowing through the outlet of the cylinder 18 into the silencer inlet 11 predominantly flows into the first chamber 15 and after filling the first chamber 15 flow back towards the silencer inlet 11 in order to form a counterpressure against the outlet of the combustion chamber 13. The achieves that non-combusted fuel-air mixture does not reach the flow channel 12 in an uncontrolled manner while the piston 21 of the combustion motor 10 is in the lower dead centre position and a change of loading is taking place in the combustion chamber 13. Due to the flow-beneficial design of the flow channel 12 the exhaust gas initially flows through the silencer inlet 11 into the first chamber 15 and fills it. Through the excess pressure in the first chamber 15 the exhaust gas then flows back towards the silencer inlet 11, so that the exhaust gas flows through the flow channel 12 and the connection piece 25 in two directions.

Figure 2:
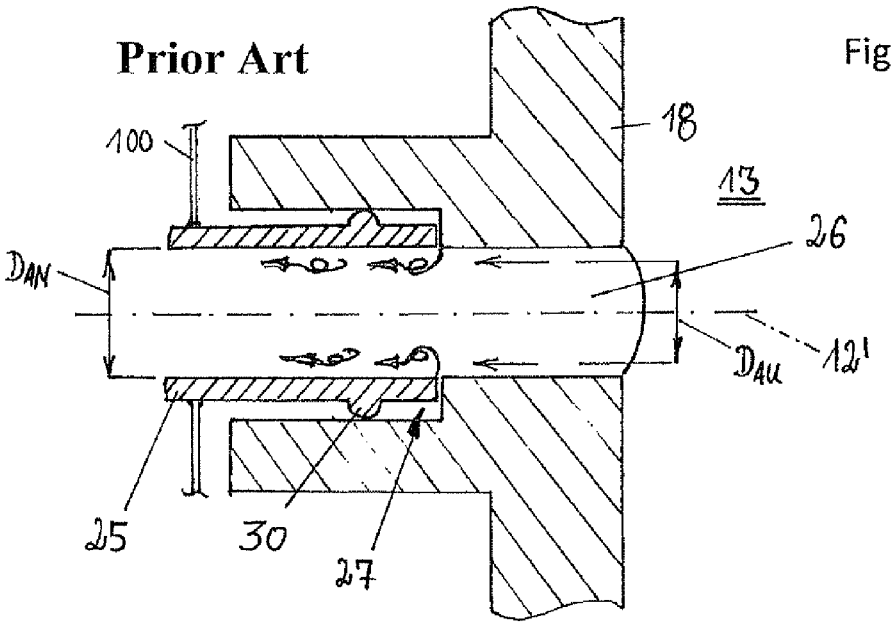
FIG. 2 shows an arrangement of a connection piece of a silencer on the outlet of a cylinder in accordance with the prior art.

FIG. 2 shows a detailed view of the arrangement of the connection piece 25 on the outlet 26 of the cylinder 18 in accordance with the prior art. The connection piece 25 extends concentrically about a channel flow direction 12', and becomes the flow channel 12. The connection piece 25 is flush with the outlet 26 in the cylinder 18, so that the outlet 26 is also concentrically arranged around the channel flow direction 12'.

The silencer 100 is shown as an example as part of the housing and the connection piece 25 has a centring attachment 30 for centring the connection piece 25 concentrically to the channel flow direction 12' on the outlet 26 of the cylinder 18. The connection piece 25 is formed in one piece with the flow channel 12, but "Portliners" are known which form an intermediate piece between the silencer 100 and the cylinder 18 of the combustion motor 10. The purpose of this intermediate piece is so that hot exhaust gases leaving the combustion chamber 13 and entering the silencer 100 do not directly affect the material of the cylinder 18. These Portliners are preferably made of sheet steel and form a connection piece 25 between the outlet 26 of the combustion chamber 13 in the cylinder 18 and the silencer 100. As described in the introduction, edges and projections in the flow connection between the combustion chamber 13 and the silencer 100 can cause disturbances to the exhaust gas flow which must be avoided so as not to negatively influence the effect of the advantageous exhaust flow of the type described above.

Figure 3:
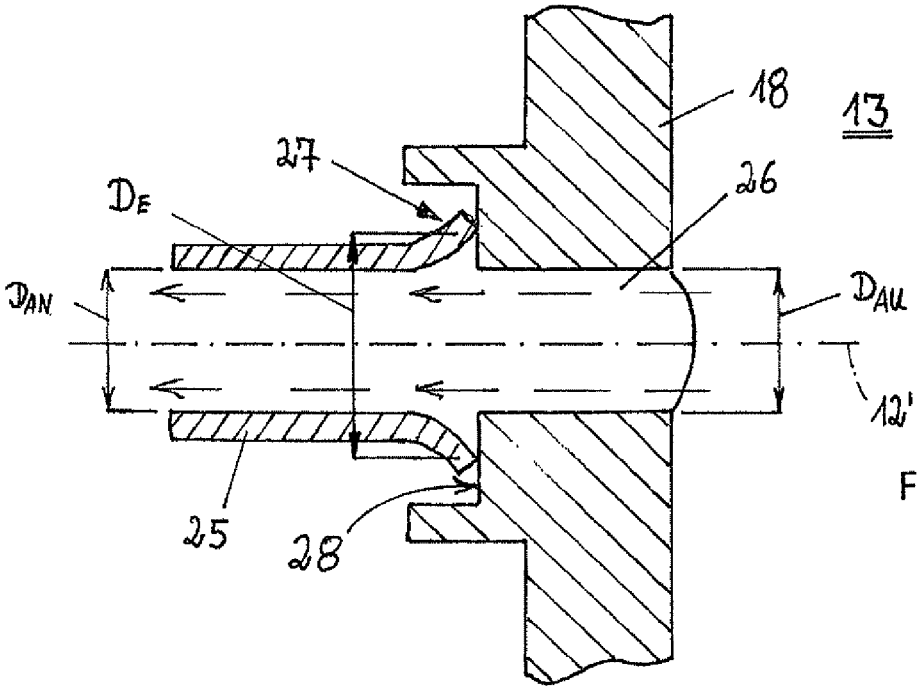
FIG. 3 shows a first example of embodiment of the arrangement in accordance with the invention of the connection piece on the outlet of a cylinder.

FIG. 3 shows a first example of embodiment of a connection piece 25, which with the outlet 26 of the cylinder 18 is concentrically arranged around the channel flow direction 12' on the cylinder 18. The example of embodiment shows a connection piece 25 with an internal diameter $D_{AN}$ of the connection piece 25 which is the same as the internal diameter $D_{AU}$ of the outlet 26. In accordance with the invention the connection piece 25 has an end area 27 with which the connection piece 25 adjoins a contact surface 28 on the cylinder 18. The end area 27 has an internal diameter $D_E$, which is larger than the internal diameter $D_{AN}$ of the connection piece 25. This results in a funnel or tulip-like widening of the end area 27 so that flow connection between the combustion chamber 13 in cylinder 18 and silencer 100 adjoining the connection piece 25 has no edges or projection through which vortices could form in the exhaust gas flow.

Figure 4:
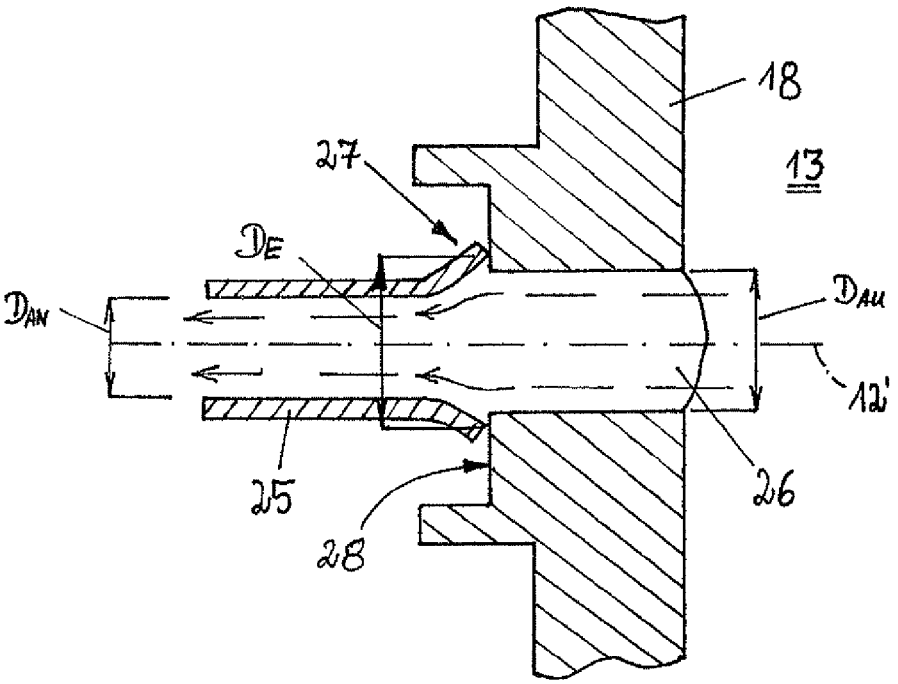
FIG. 4 shows a second example of embodiment of the arrangement of a connection piece on the outlet of cylinder and FIG. 5 shows a third example of embodiment of the arrangement of a connection piece on the outlet of a cylinder.

FIG. 4 shows a further example of embodiment of the arrangement of the connection piece 25 on the outlet 26 of the cylinder 18. The connection piece 25 has an internal diameter $D_{AN}$, which is smaller than the internal diameter $D_{AU}$ of the outlet 26. However, the end area 27 of the connection piece 25 is widened in such a way that the internal diameter $D_E$ of the end area 27 is larger than the internal diameter $D_{AU}$ of the outlet 26. This produces a flow constriction, which, however, has no disruptive influence on the exhaust gas flow, particularly when the exhaust gas flows out through outlet 26 and the adjoining connection piece 25 into the silencer 100. The connection piece 25 as well as the outlet extend in a rotationally symmetrical manner around the channel flow direction 12'. In the case of an off-centre arrangement of the connection piece 25, as can occur, for example, through vibrations, incorrect assembly etc., the exhaust gas flow is still not negatively affected as only the position of the end area 27 moves in adjoining arranged on the connection surface 28, but without forming edges that disrupt the exhaust gas flow.

Figure 5:
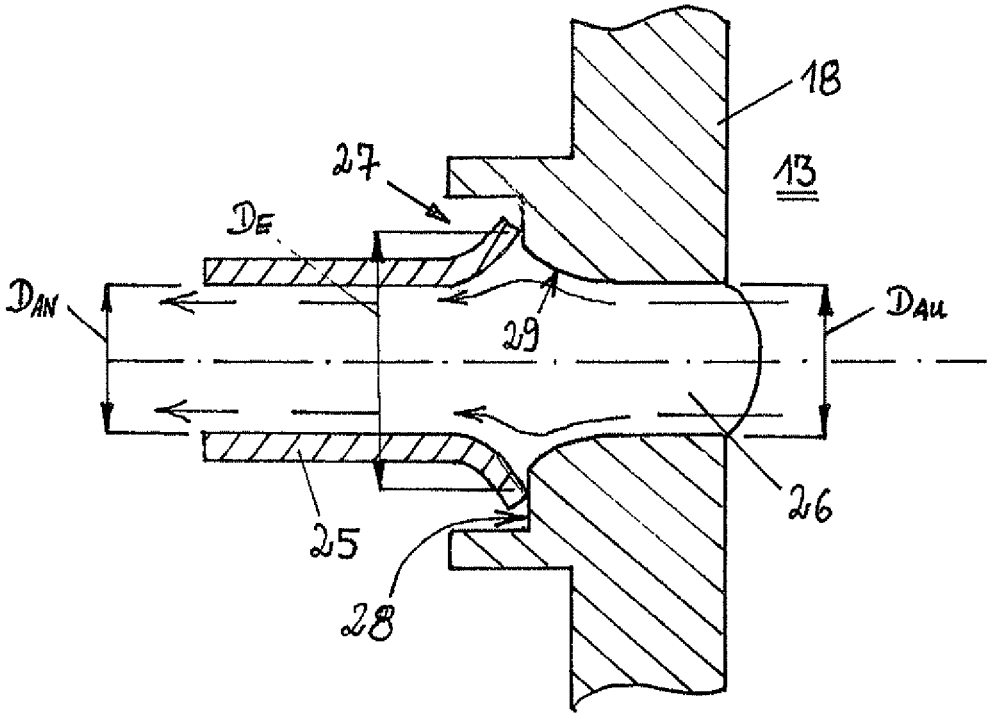

FIG. 5 show a further example of embodiment of the arrangement of a connection piece 25 on the outlet 26 of the cylinder 18. The connection piece 25 in turn has an end area 27 auf, and internal diameter $D_E$ of the end area 27 is larger than the internal diameter $D_{AN}$ of the connection piece 25. In this example of embodiment the internal diameter $D_{AN}$ of the connection piece 25 corresponds with the internal diameter $D_{AU}$ of the outlet 26. A rounded area 29 is provided which forms a rounded transition from the outlet 26 to the connection surface 28. The connection surface 28 is a planar surface and extends radially around the outlet 26 so that the channel flow direction 12' forms a normal to the connection surface 28. The internal diameter $D_E$ of the end section 27 is such that the end section 27 adjoins the connection surface 28 which has already become planar in annular linear contact. This produces flow of exhaust gas between the combustion chamber 13 and the silencer 100, which in a first flow direction, namely from the combustion chamber 13 to the silencer 100, has no disruptive edges, and the return flow from the silencer 100 into combustion chamber 13 is also not negatively affected by an edge.

Through the measures in accordance with the invention set out in the above-described examples of embodiment, the positive effect of the exhaust gas return flow can be further improved. If the flow of the exhaust gas from the silencer 100 to the combustion chamber 13 of the combustion motor 10 is not negatively affected by edges of projections so that vortices could form, positive use can be made of the effect that the exhaust gas flowing back in the direction of the combustion chamber 13 forms a gas barrier, whereby the flow of the exhaust gas can even reach the speed of sound. There are also advantages through simplified assembly by way of assembly means which are not shown more specifically here, but allow simpler pressing of the connection piece 25 with the end area 27 against the connection surface 28 of the cylinder 18.

The invention is not restricted to above preferred forms of embodiment. Rather, a number of variants are conceivable which make use of fundamentally different embodiments from the shown solution. All features and/or advantages, including structural details or spatial arrangements evident from the claims, the description or the drawings can be essential to the invention in themselves and in various combinations. For example, the rounded area 29 shown in FIG. 5 can also be used in the example of embodiment in FIG. 4, which shows a connection piece 25 with a diameter differing from the diameter of the outlet 2. It is also possible for the diameter of the connection piece 25 to be larger than the diameter of the outlet 26.

LIST OF REFERENCES

100 Silencer
10 Combustion motor

11 Silencer inlet
12 Flow channel
12' Flow channel direction
13 Combustion chamber
14 Channel end
15 First chamber
16 Second chamber
17 Main outlet
18 Cylinder
19 Outlet
20 Secondary outlet
21 Piston
22 Crankshaft
23 Connecting rod
24 Crank housing
25 Connection piece
26 Outlet
27 End section
28 Connection surface
29 Rounded area
30 Centring attachment
$D_{AN}$ Internal diameter of the connection piece
$D_{AU}$ Internal diameter of the outlet
$D_E$ Internal diameter of the end section

The invention claimed is:

1. An arrangement of a silencer on a combustion motor, whereby the silencer has a connection piece expanding radially outwardly with an end section adjoining an outlet in the cylinder of the combustion motor and forming a flow connection between a combustion chamber of the combustion motor and the silencer, wherein the internal diameter of the end section is larger than internal diameter of the outlet.

2. The arrangement in accordance with claim 1, wherein the connection piece has an internal diameter which increases continuously and free of jump in diameter into the end area up to the internal diameter of the end area.

3. The arrangement in accordance with claim 1, wherein the internal diameter of the connection piece and the internal diameter of the outlet have the same value.

4. The arrangement in accordance with claim 1, wherein the internal diameter of the connection piece is smaller than the internal diameter of the outlet.

5. The arrangement in accordance with claim 1, wherein the cylinder has planar connection surface, whereby the connection piece is held with retaining means with the end area adjoining the connection surface.

6. The arrangement in accordance with claim 1, wherein the connection surface has a transition area which passes from a planar area of the connection into the outlet forming a rounded area.

7. The arrangement in accordance with claim 1, wherein radially around the outlet the connection surface has a planar extension such that off-centre connection piece on the outlet is possible while the flow connection between the combustion chamber of the combustion motor and the silencer remains free of edges.

8. The arrangement in accordance with claim 1, wherein the connection piece and more particularly the end section of the connection piece is arranged in a rotationally symmetrical manner around a channel flow direction whereby the end area is formed by a funnel-like widening of the connection piece.

9. The arrangement in accordance with claim 1, wherein the connection piece with its end area forms silencer inlet which becomes a flow channel, whereby at the channel end opposite the silencer inlet the flow channel opens out into a first chamber, whereby the flow channel between the silencer inlet and the first chamber is so flow-beneficially designed that due to its mass inertia the exhaust gas flowing into the silencer inlet predominantly flows into the first chamber and after filling the first chamber flows back again and thereby forms a counterpressure in the direction of the combustion chamber.

10. The arrangement in accordance with claim 1, wherein a second chamber is provided into the exhaust gas flows through a main outlet branched from the flow channel and from which the exhaust gas flows out through an outlet.

* * * * *